United States Patent [19]

Allen

[11] Patent Number: 4,614,380

[45] Date of Patent: Sep. 30, 1986

[54] POWER DRIVEN ROTARY FLOOR PREPARATION DEVICE

[75] Inventor: Larry D. Allen, Enumclaw, Wash.

[73] Assignee: The Boeing Company, Seattle, Wash.

[21] Appl. No.: 698,433

[22] Filed: Feb. 5, 1985

Related U.S. Application Data

[63] Continuation-in-part of Ser. No. 549,271, Nov. 3, 1983, abandoned.

[51] Int. Cl.[4] ..... A47L 11/14; A47L 13/08

[52] U.S. Cl. ..... 299/41; 299/90; 299/92; 15/236 R; 403/388

[58] Field of Search ..... 299/39, 41, 74, 77, 299/90, 92; 15/93 R, 236 R; 403/388

[56] References Cited

U.S. PATENT DOCUMENTS

| | | | |
|---|---|---|---|
| Re. 19,613 | 6/1935 | Myers | 51/177 |
| 1,698,611 | 1/1929 | Teague et al. . | |
| 1,901,681 | 3/1933 | Vicenzi . | |
| 1,924,582 | 8/1933 | Wineman | 51/177 |
| 1,932,319 | 10/1933 | Myers | 51/177 |
| 1,958,077 | 5/1934 | Vinella | 51/177 |
| 2,702,712 | 2/1955 | Snyder et al. | 279/79 |
| 2,713,757 | 7/1955 | Brennecke | 51/177 |
| 2,793,476 | 5/1957 | Lombardo | 51/177 |
| 2,923,107 | 2/1960 | Biasoni | 51/177 |
| 3,098,329 | 7/1963 | Doran | 51/177 |
| 3,102,372 | 9/1963 | Vezner | 51/177 |
| 3,361,044 | 1/1968 | Wolf et al. | 94/45 |
| 3,428,984 | 2/1969 | Collier | 15/49 |
| 3,509,648 | 5/1970 | Smith | 37/142 |
| 3,522,679 | 8/1970 | Sundberg | 51/317 |
| 3,591,884 | 7/1971 | Grueb | 15/98 |
| 4,186,967 | 2/1980 | Kuhmonen | 299/25 |
| 4,219,898 | 9/1980 | Presby | 15/49 |
| 4,303,362 | 12/1981 | Lockhart | 411/153 |
| 4,531,253 | 7/1985 | Cottam | 15/93 R |

*Primary Examiner*—Stephen J. Novosad
*Assistant Examiner*—Michael A. Goodwin
*Attorney, Agent, or Firm*—Eugene O. Heberer

[57] ABSTRACT

A motor driven rotary scraper assembly (10) for use on concrete floors for removing adhering residues includes a plate (12, 180) for rotary driving attachment to a motor rotatable device. There are a plurality of annularly spaced scraper units (50, 112, 182) secured to the plate. Each scraper unit (50, 112, 180) has floating blades (52, 116, 190). The scraper units (50, 112) include a support member (80, 160) having limit or pivot means (92, 130, 270) to limit upward movement of the blade (52, 116, 190).

59 Claims, 17 Drawing Figures

Fig. 15
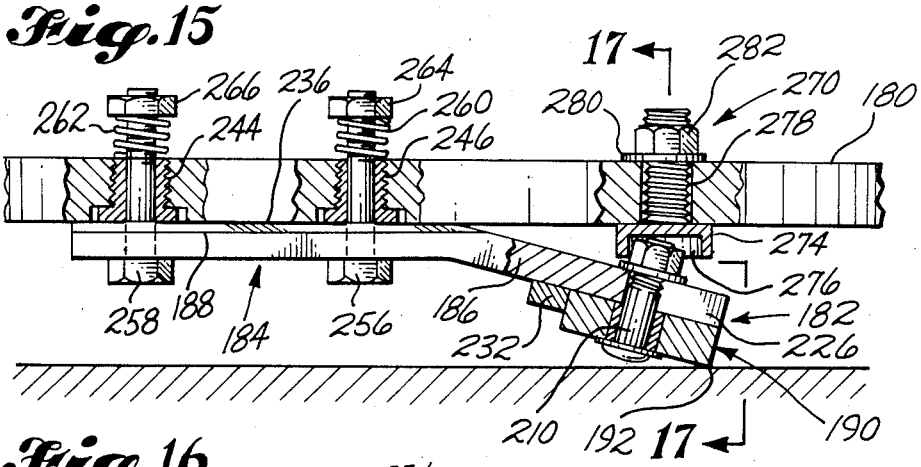
Fig. 16
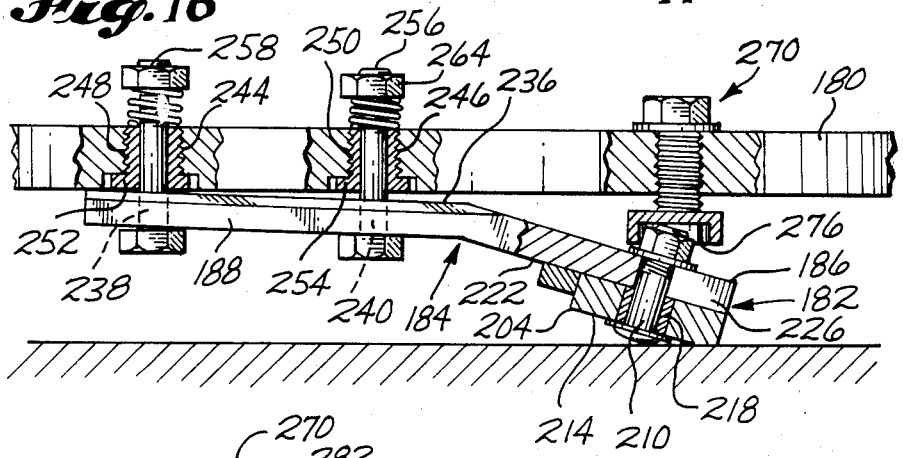
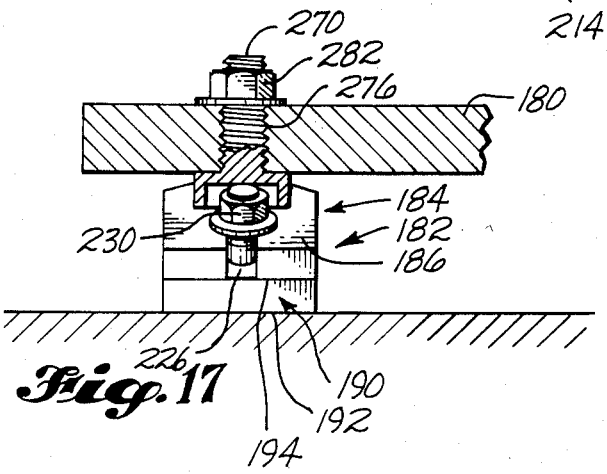
Fig. 17

POWER DRIVEN ROTARY FLOOR PREPARATION DEVICE

CROSS REFERENCE TO RELATED APPLICATION

This application is a continuation-in-part of my application entitled, Motor Driven Rotary Floor Scraper, Ser. No. 549,271, filed Nov. 3, 1983, now abandoned.

TECHNICAL FIELD

The invention relates to an electric motor driven rotary scraper designed for use on concrete floors, and the like, for removing adhesive residues, old asphalt tile, plastic and varnish floor coatings, and built-up paint prior to the application of a new floor treatment or general cleaning.

BACKGROUND ART

In the prior art adhesive residues, old asphalt tile, varnish and plastic finishes, and built-up paint have been removed from concrete floors by the application of strong solvents poured on selected concrete surfaces. About one gallon of such solvents were used per hundred square feet. After soaking, the softened material was peeled by hand tools and removed from the surface by flushing with water. All waste material and water was isolated, collected, and disposed as hazardous waste.

A search of the patent literature was made to determine what tools might be available to remove the above materials from a concrete floor. A number of floor cleaner patents were found. For example, U.S. Pat. No. 4,219,898 discloses a floating brush arrangement in which a plurality of brushes are pivotally connected to a bottom face of a floor polishing machine. Each brush is independently connected and is biased downwardly by a toggle type spring so that the brush is capable of tracking on an uneven contour of the floor.

U.S. Pat. No. 3,591,884 is for a machine for pointing ceramic tiles. A rotatable plate has on its underside resilient, slanted steel blades and which are completely covered, on the side facing the material to be processed, with a felt or plastic pad.

U.S. Pat. No. 3,522,679 illustrates a concrete abrading machine which drives a disk having steel rubbing pads attached to its bottom surface. The side edges of the pads are slightly curved and have leading faces rotationally leading the main part of the pad and tapering rearwardly in spiral fashion around the axis of the disk. The leading faces are congruent with the periphery of the disk. During their rotation the pads tend to force material that they engage toward the center of the disk, while rubbing it upon the floor surface.

U.S. Pat. No. 3,361,044 illustrates a cement finishing apparatus having a water tank mounted on the frame from which water can be sprayed onto the fresh cement.

U.S. Pat. No. 2,702,712 discloses mining machine bits or blades with leading and trailing surfaces, the blades being bent and having a hardened insert. There is a support plate for the blade, the support plate having a retaining spring, the spring having an inturned tongue from one end extending into the bit to prevent accidental displacement of the bit from a socket.

U.S. Pat. No. 1,698,611 discloses a biasing means to bias a blade towards a support plate.

U.S. Pat. No. 4,186,967 discloses a rotary scraper having rotary plates with a plurality of cutting bits located angularly around the plates.

the following patents disclose devices similar to those described above:

U.S. Pat. No. Re 19, 613
U.S. Pat. No. 1,901,681
U.S. Pat. No. 1,924,582
U.S. Pat. No. 1,932,319
U.S. Pat. No. 1,958,077
U.S. Pat. No. 2,713,757
U.S. Pat. No. 2,793,476
U.S. Pat. No. 2,923,107
U.S. Pat. No. 3,098,329
U.S. Pat. No. 3,102,372
U.S. Pat. No. 3,428,984.
U.S. Pat. No. 3,509,648
U.S. Pat. No. 4,303,362

DISCLOSURE OF THE INVENTION

The invention is an electric motor driven rotary scraper assembly which connects by an adaptor to a heavy duty electrical floor polishing unit. The scraper assembly is formed of a generally disk-shaped plate having a plurality of angularly spaced scraper units secured to the plate bottom. Each scraper unit has an elongated scraper blade or blade holder having a carbide tip on its leading end and is formed to have leading and trailing portions.

Each blade holder is bent or formed at an intermediate portion so that the leading portion depends from the trailing portion, extending away from the disk-shaped plate and extends toward a concrete floor being scraped. Each scraper unit also has an elongated, plate protecting spacing member or support extending on an upper surface of the trailing portion of the blade and is between the blade and the disk-shaped plate in contact therewith. The spacing member has a leading portion extending over the leading portion of the blade holder and has a downwardly directed leading end adjacent the leading portion of the blade so as to limit upward movement of the blade and blade holder toward the disk-shaped plate and to provide a pivot point for the blade.

The trailing portions of the blade holder are transversely curved or brake bent along the spacing member, the transverse curve being convex with respect to the spacing member and the curve has an elongated top or apex forming an upper surface of the trailing portion in contact with the spacing member. The top is in the approximate transverse center of the trailing portion.

Each scraper unit is secured to the plate by fasteners extending through the transverse center, the top of the convex curve, the spacing member, and the plate. Coil springs surround each fastener and extend between the plate and a nut on the upper end of the fastener above the plate. The springs thus bias the blades toward the plate and permit the carbide tips on the blades to adjust to surface irregularities of a floor and at the same time make contact with the original floor surface. That is, the blades are adapted to float, permitting the leading end to be moved upwardly and downwardly by the floor surface irregularities and permitting the blades to rotate transversely on the convex curve or brake bend against the plate protecting spacing member in accordance with floor irregularities.

Three blades are annularly spaced on the plate and the side edges extend generally in the direction of rotation, and the leading edges of the carbide tips extend generally transverse to the direction of rotation. The leading edges and side edges are formed or sharpened to be generally rectangular with respect to each other.

In a second embodiment of the invention, the blade, formed of carbide steel, is rectangular and has eight edges which may be positioned on a blade holder so that each of the eight edges may be a leading and scraping edge. The blade is secured to the underside of the blade holder by means of a fastener and is supported against rearward movement by a bar extending transversely across the blade holder and in contact with a trailing transverse edge of the blade, the leading edge of the blade being transverse and parallel to the trailing edge. A disk-protecting supporting spacing member has a downwardly facing recess, adapted to receive an upwardly extending end of a fastener holding the blade on the holder, the fastener acting as a protrusion and pivot to limit the upward movement of the blade with respect to the rotatable plate, and to restrict movement of the blade in the lateral directions. The blade in this embodiment is not permanently secured to the blade holder and may be easily replaced for a nominal cost.

A third embodiment of the invention has the same kind of eight-edged blades secured to a blade holder but does not necessarily employ the use of a supporting or spacing member. That is, the blade holder is directly attached to the rotatable plate which is protected by hardened inserts. In this embodiment, an adjusting bolt is threadedly engaged into the rotatable plate and is positioned so that the fastener holding the blade on the blade holder engages the adjusting bolt as the blade moves upwardly so as to limit its upward movement and to restrict movement of the blade in the lateral directions. As a leading edge of the blade that is in use wears, the adjusting bolt may be accordingly lowered so as to limit the upward movement of the blade the same amount that it was permitted before the wear. By loosening a leading spring biased fastening nut and the adjusting bolt, the pitch of the blade is changed so as to give it a new cutting edge. This adjusting extends the life of each of the eight edges of the blade up to 500% under ideal conditions.

A water attachment can be applied to dampen dust made in the scraping operation, if necessary. The scraper, according to the invention, removes layers of paint, floor seals, oil grease grit, threshold non-skid materials, tile, glue, and undesirable adhering coatings from generally smooth surface concrete floors having typical irregularities, including holes and short bolts extending upwardly from the floor surface. The operation is highly successful in that it removes the aforesaid materials from floors without damaging the floor. The materials are removed in granule form, as shavings, or chunks in accordance with the nature of the material. The materials removed can be easily swept up or vacuumed, leaving the floor completely clean.

The present invention eliminates the use of solvents described above, the labor required to apply the solvents and to lift the material from the floor, and the costs of hazardous waste disposal. The chemical stripping described above has been found to cost $146.80 per hundred square feet and the stripping with the present invention has been found to cost $6.49 per hundred square feet. Thus, the present invention saves $140.31 per hundred square feet or $1.40 per square foot.

Recurring costs for the reconstruction of the invention are relatively negligible as the plates can be made from scrap material and the blades are a stock item which require infrequent resharpening.

The invention can also be used with the springs tightened against the plate to remove substantially all of the floating action of the blade when used on surfaces which have a thick rough coating to be removed. When the blades are so tightened, if used on a thin coating surface, they will tend to scratch the floor surface and will not remove the coating as effectively as when the blades are permitted to float.

Further advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings which are for illustrative purposes:

FIG. 15 is a side elevational view of the embodiment shown in FIG. 13;

FIG. 16 is a side elevational view, similar to that in FIG. 15, illustrating an adjustment feature to accommodate for wear on a leading edge of a blade; and FIG. 17 is an end view taken along the lines 17—17 in FIG. 15.

BEST MODE FOR CARRYING OUT THE INVENTION

Figure 1:
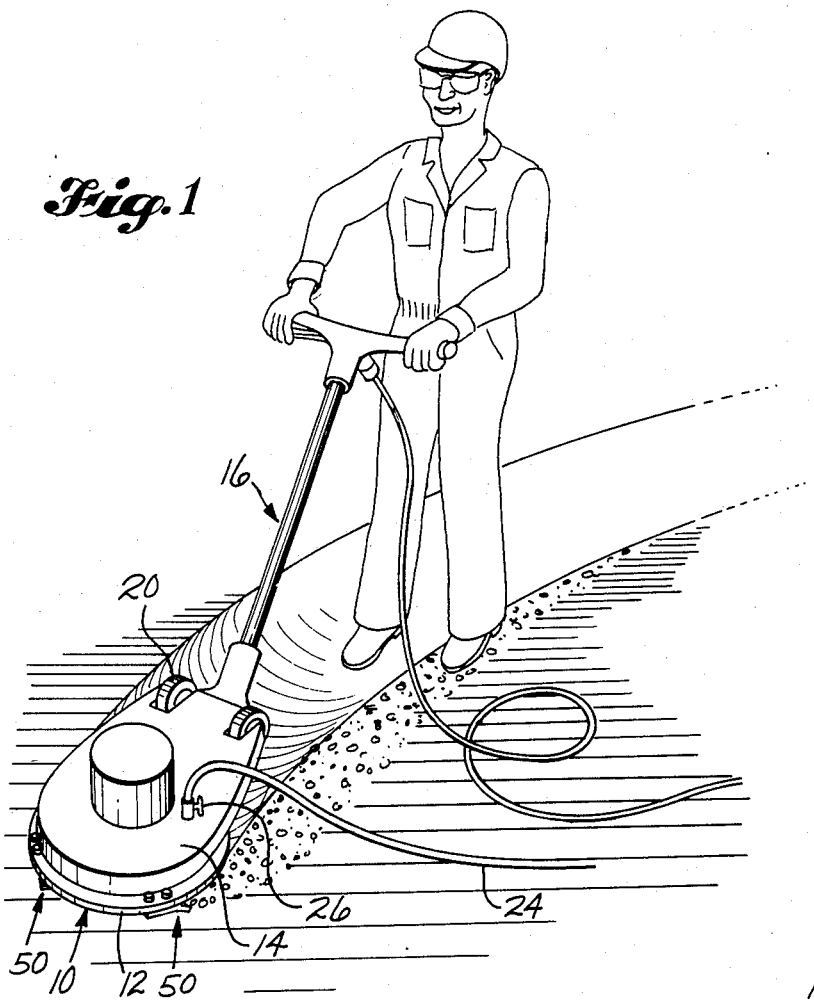
FIG. 1 is a pictorial view illustrating the operation of the invention.

Referring again to the drawings, there is shown in FIG. 1 an electric motor driven rotary scraper assembly, generally designated as 10, for use on concrete floors and the like, for removing adhesive residues, old asphalt tile, and built-up floor coatings. The device is particularly adapted for use on relatively smooth concrete floors which have inadvertently positioned adhesive residues secured thereon and which must be removed for cleaning purposes. It is used to remove residues and ordinary coatings from a concrete floor to prepare the floor for the application of a new floor treatment.

The upper part 14, above a lower disk-shaped rotatable plate 12, may be a typical heavy duty electrical floor polishing unit. The device 10 has a standard pushing and guiding handle 16 and rear wheels 20 on which the rear lower portion of the device rests and on which the device moves and is guided on a floor. In the event that the operation of the device 10 causes an excessive amount of dust, a water supply hose 24 is attached and the water supply is controlled into the device by a valve 26.

Figure 3:
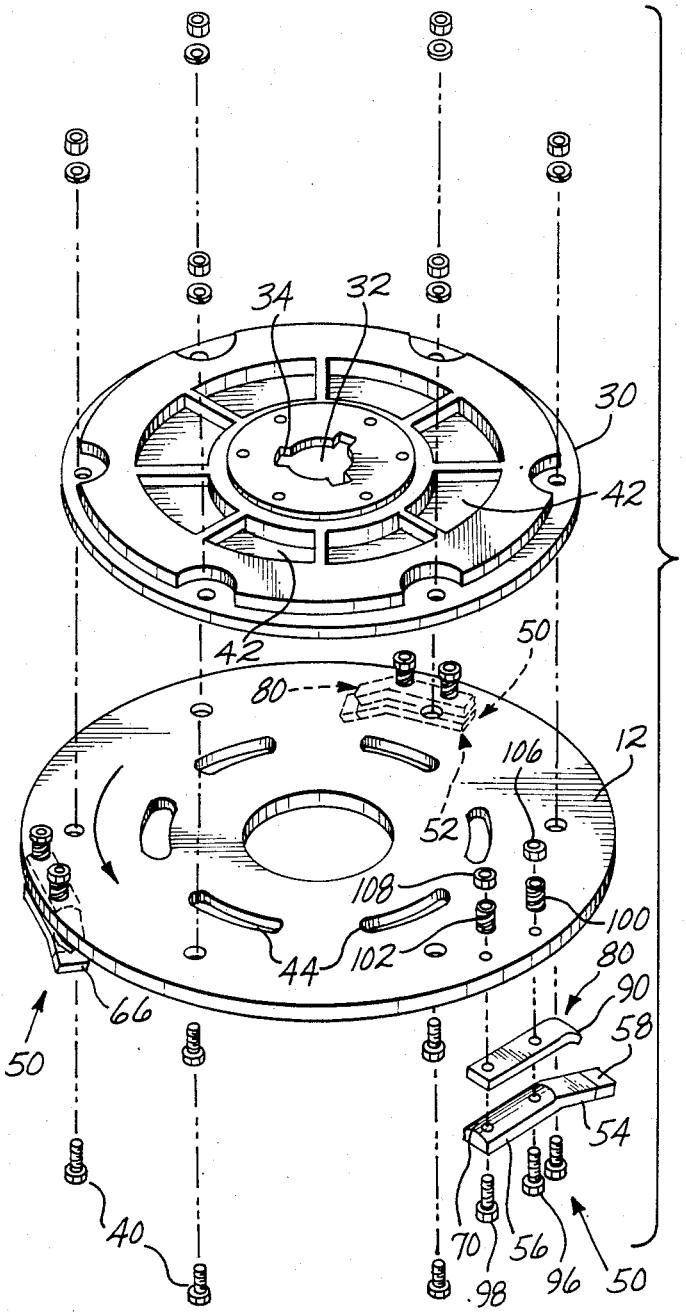
FIG. 3 is a partially exploded view of the combination forming the invention.
Figures 9, 10:
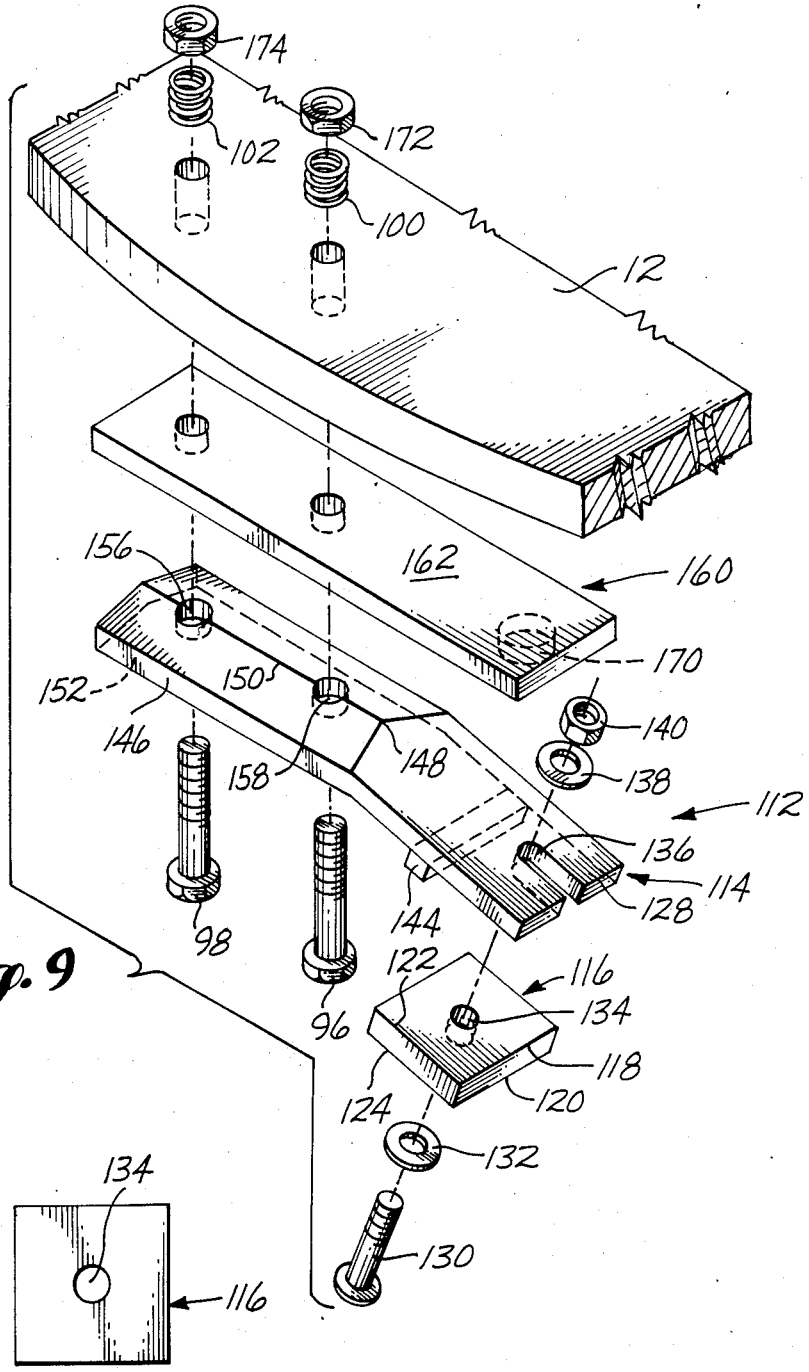
FIG. 9 is an exploded view illustrating another embodiment of the invention in which a blade holder has a blade having eight hardened edges, each of which is positionable to be a leading edge.
FIG. 10 is a plan view of the blade in FIG. 9.
Figure 11:
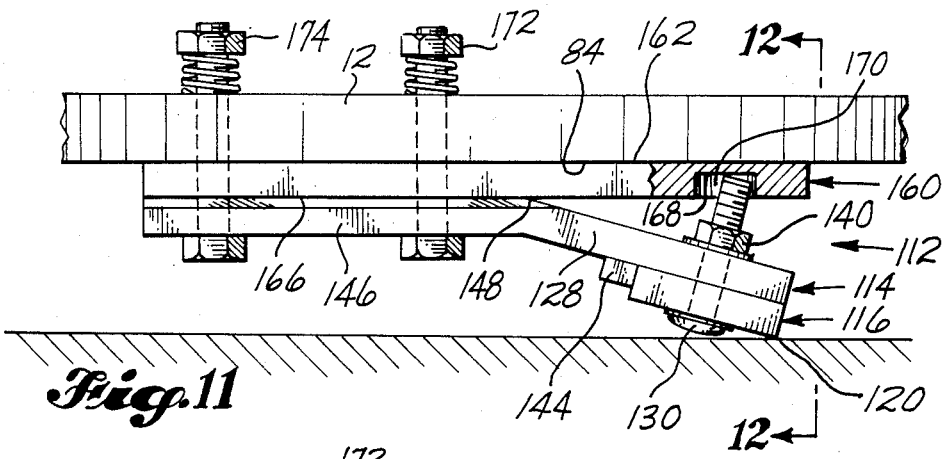
FIG. 11 is a side elevational view of the embodiment shown in FIG. 9.
Figure 12:
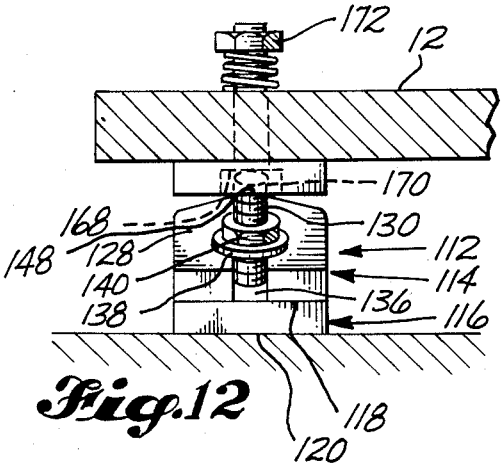
FIG. 12 is an end view of the embodiment shown in FIG. 9, taken along the lines 12—12 in FIG. 11.
Figure 13:
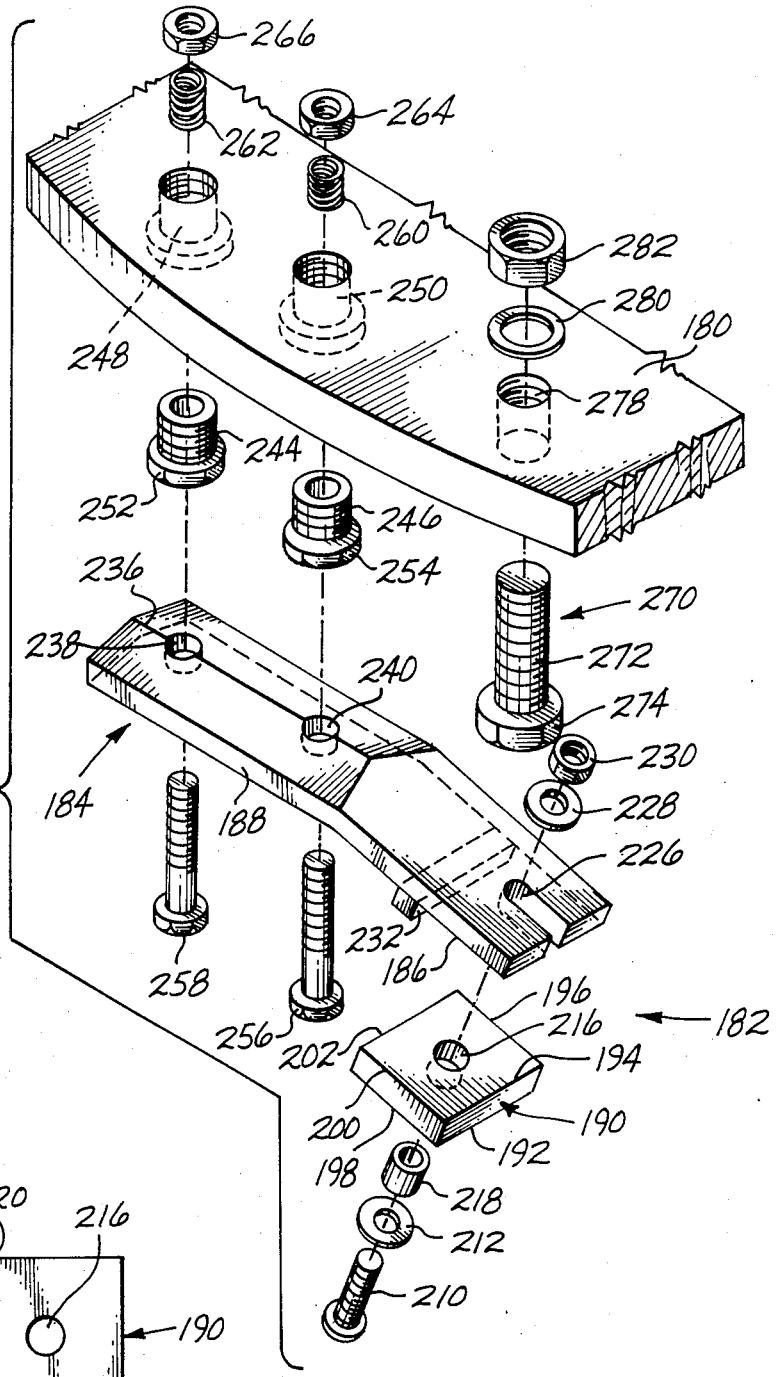
FIG. 13 is an exploded view of still another embodiment of the invention.
Figure 14:
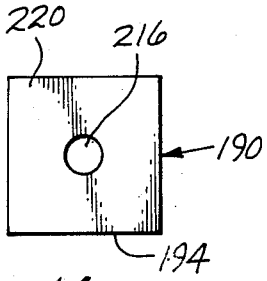
FIG. 14 is a plan view of a blade member of the embodiment shown in FIG. 13.

As shown in FIG. 3, an adapter plate 30 has a central opening 32 with three rectangular, radially directed grooves 34 which are adapted to engage a complementary male driving shaft end of the floor polishing unit. When so engaged, the floor polishing unit drives the plate 30 in rotation and its scraper plate 12 attached thereto by a plurality of bolts 40. The plate 30 has annularly spaced openings 42 connected to the water source 24 and connected to annular slots 44 in the plate 12. Water, if used, would drip through the annular slots 44 on a floor beneath the scraper plate 12.

Figure 4:
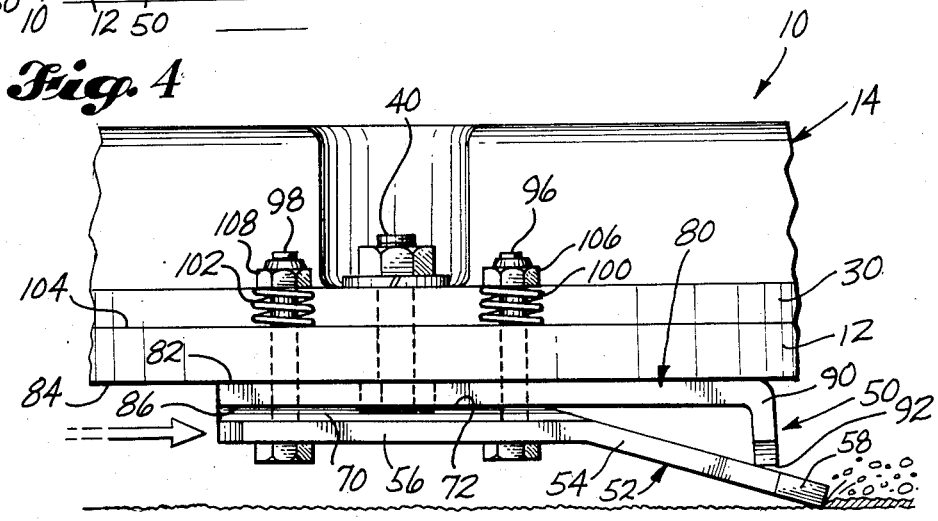
FIG. 4 is a side view of a scraper unit, according to the invention.
Figure 2:
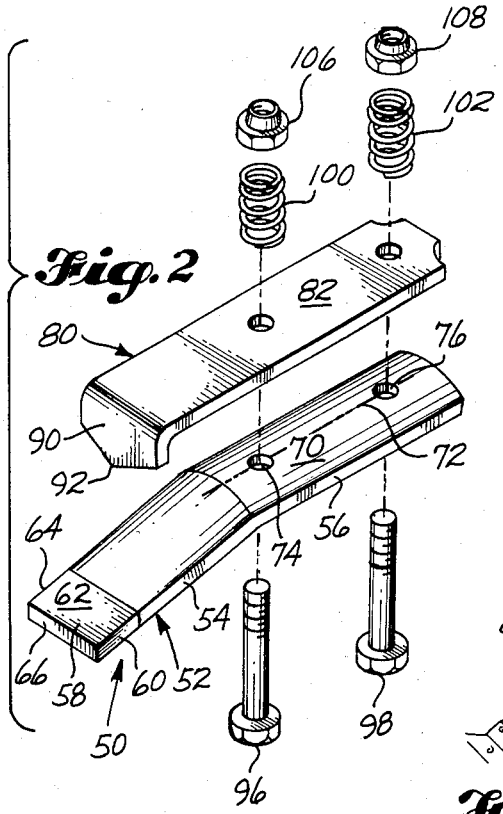
FIG. 2 is an exploded view of a subcombination of the invention including a blade, a supporting device, fasteners and coil springs.

As shown in FIGS. 2–4, the inventive combination is formed on scraper plate 12, secured to the plate 30 by the bolts 40. The inventive assembly on the rotatable plate 12 is comprised of three equally, annularly spaced scraper units, generally designated 50. Each unit 50 has an elongated blade or blade holder 52 having a leading portion 54 and a trailing portion 56. The blades are made of steel and have a carbide tip 58, having trailing edges 60, 62 and 64 in the elongated direction and trailing from a transverse leading end 66. The leading and trailing edges are joined at substantial right angles.

The leading portion 54 is bent downwardly from the trailing portion 56 which has an upwardly facing convex or transversely brake-type bent surface 70 having its top or apex surface or center line 72 extending along the transverse center in the elongated direction. The trailing portion is formed of generally straight line parallel surfaces in the elongated direction. The lower surface, not shown, of the trailing portion 56, has a downwardly opening concave surface, complementary to the upper surface 70. Bolt holes 74 and 76 extend through the trailing portion and have their centers generally along the transverse center line 72.

Above the blade holder is a rotatable plate-protecting, plate or spacing member 80, formed of generally straight line surfaces, and having its upper surface 82 in contact with lower surface 84 of the plate 12 and having its lower surface 86 normally in contact with the elongated transverse center 72 of the trailing portion of the blade. The support plate 80 has bolt holes complementary to those in the trailing portion of the blade. Elongated support 80 is shorter than the blade and has its leading end 90 extending downwardly to a transversely centered lower pointed end 92 which forms a pivot point and an upward limit stop for the blade leading end 54. Normally the point 92, FIG. 4, is adjacent the leading end of the blade or in contact therewith. Transversely the support 80 and the blade 50 have substantially the same width. The blade 52 and the support 80 are secured to the underside 84 of the plate 12 by means of a leading bolt 96 and a trailing bolt 98. The parts of the units 50 are positioned inwardly of the periphery of the plate 12 to avoid damage to areas above the floor.

Surrounding the upper ends of the bolts are springs 100 and 102 having their lower ends in biasing contact with upper surface 104 of the plate 12 and having their upper ends tightened by nuts 106 and 108. The nuts are tightened so that the springs normally bias the bolts, the blade and the support 80 toward the plate 12.

Typical concrete floors, although they appear to be smooth and level, have high and low spots which prior art scrapers would tend to damage by excessive digging into the floors. The present invention while rotating at a typical speed of an electrical floor polishing unit has the novel advantage of having scraping blades which float and adjust to variations in floor pitch or level, while the scraping blades are rotating across the floor in the 360° rotation, indicated by the arrows in FIGS. 3 and 4.

Figure 7:
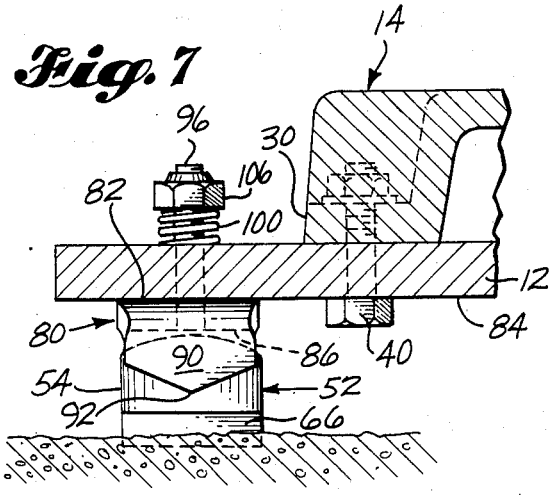
FIG. 7 is an end view of a scraper unit with the blade tipped downwardly with respect to the remainder of the scraping unit.

FIG. 4 illustrates a normal operating situation where the blade is moving smoothly and not being raised or lowered. The lower forward end 92 on the support 80 in such an operation tends to be in contact with the upper forward portion of the blade and will tend to remain so until the blade of an individual scraping unit goes into a low spot on the floor or into a higher spot or moves onto residues or obstacles which tend to increase resistance. When the blade hits a higher spot, it at first tends to dig in, as indicated in FIG. 7, the blade moving downwardly and causing the forward spring 100 to be compressed, allowing the after spring 102 to be somewhat extended. That is, the forward end of the blade moves downwardly against the force of the spring 100 and tends to move away from the end 92. However, immediately afterward as it moves along against a protrusion, the blade raises and moves against the point 92 and tends to raise it and pivot thereon so as to lessen the load on the spring 100 and to compress the spring 102, the trailing end of the blade tending to move downwardly.

Figure 5:
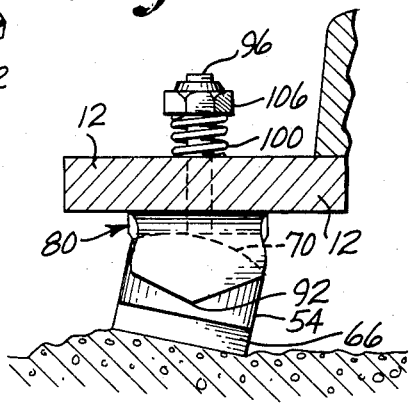
FIG. 5 is an end view of a scraper unit in operation, illustrating transverse rotation of a blade in one direction.
Figure 6:
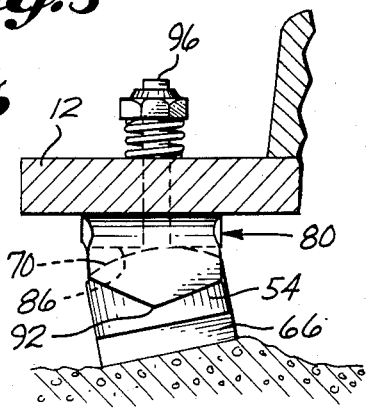
FIG. 6 is a view similar to FIG. 5, illustrating transverse rotation of the blade in the other direction.

FIGS. 5 and 6 illustrate the transverse rotation of the blade on its convex surface 70 on the surface 86 of the support. In FIG. 5, the rotation in the drawing is to the right because the residue on the floor is elevated to the left. The opposite is true in FIG. 6.

It should be noted that there are two elements affecting operation of the invention. One is the normal smoothness or lack of smoothness of the floor, namely, the floor contour, and the other is the nature of the residue which is being removed from the floor. In all cases, the flotation or adjustment of the individual blades results in their moving down to the concrete floor so that the floor is cleaned and undamaged in a very fast operation. For example, varnish or smooth plastic coatings are removed in granule form with no creation of noticeable dust and may be either swept up or vacuumed. Certain other materials are removed in the form of shavings such as of potato peelings or plane cuttings. In other situations where a substantial amount of plastic material, for example, has been dropped onto a floor and hardened so as to adhere to the floor, the material may be removed in chunk form until the residue becomes more nearly level and thinner, and then the scrapers remove the remaining residue in a more granule-like form. In any event the materials are removed without damaging the floor and in many situations at the rate of one hundred square feet in eleven minutes, and where the savings over chemical and hand tool scraping methods have been at the rate of $1.40 per square foot.

The carbide tips on the blades retain their sharpness for a considerable length of time partially because of the hardness of the carbide, and also because of the manner in which the blades are biased upwardly by the two springs and allowed to float so as to move upwardly, downwardly, and transversely to remove undue resistance on the sharp end of the blade.

Figure 8:
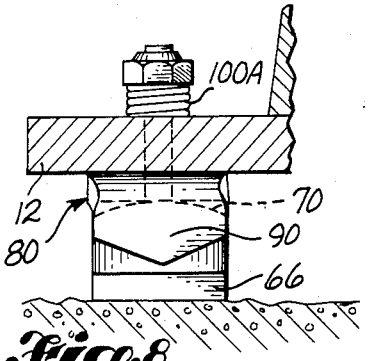
FIG. 8 is an end view of a scraper unit with the springs tightened by the fasteners to substantially eliminate the possibility of rotation of the blade with respect to the remainder of the scraper unit.

In some situations where the blades become dull or the residue on the floor is relatively thick the springs may be tightened down, as shown in FIG. 8, where the forward spring 100A as well as the after spring has been tightened so as to remove the upward biasing effect of the springs. When this situation has been effected, the scrapers remove the thick rough formations without difficulty but are not as effective in working against a relatively smooth floor and are not as fast as in removing the material from a relatively smooth floor. Thus, when residue has been thinned to an extent where it all can be removed from the floor, the invention should be used with the springs in position to allow the blades to float over the floor and to remove all of the residue therefrom without scraping or digging into the floor so as to cause some damage to it.

Another embodiment of the invention is illustrated in FIGS. 9–12, where an inventive combination is formed on a scraper plate 12, securable to a plate 30 as shown in FIG. 3. The inventive assembly on the rotatable disk-plate 12 is comprised of three equally, annularly spaced scraper units, only one of which is shown, generally designated as 112. Each unit 112 has an elongated blade holder 114 forming a blade with a carbide tip 116 of rectangular configuration. The carbide tip has eight scraping edges or cutting edges, as 118, 120, 122 or 124 which may be put in the position of a lower and leading edge to form an integral blade with the holder 114. In the assembly shown, the leading or scraping edge is 120.

The carbide tip 116 is secured to a leading portion 128 of the blade holder by means of a fastener bolt 130, extending through a lower washer 132, a hole 134 in the carbide tip, a slot 136 in the leading portion of the holder, a washer 138 and a securing nut 140. The slot provides for easy removal and replacement of the blade. In abutment with the carbide tip 116 is a transverse bar 144, secured to the under side of the forward portion 128 by welding or other conventional means. The bar 144 serves to support the carbide tip against rearward movement along with the bolt 130.

The blade holder has a trailing or rearward portion 146 having a transverse brake-type bend at 148 to form an upper elongated transverse generally convex contact surface or edge 150.

The portion 128 is bent or formed downwardly from the trailing portion 146 at about the bend 148. The upwardly facing convex edge or surface 150 is generally formed along a transverse centerline indicated at 150. Complementary to the upper surface of the trailing portion 146, the lower surface has a downwardly opening generally concave surface 152. Bolt holes 156 and 158 extend through the trailing portion and have their centers generally along the line or surface 150.

Above the blade holder and blade is a rotatable disk-protecting, blade support plate or spacing member 160 having its upper surface 162 in contact with a lower surface 84 of the disk-plate 12, and having its lower trailing surface normally in contact with the elongated transverse center 150 of the trailing portion of the blade holder. The support 160 has bolt holes complementary to those in the trailing portion of the blade holder. The elongated support 160 is about the same length as the blade holder and has a downwardly extending recess 170 adjacent its leading end, centrally positioned transversely, to form an upward limit stop for the pivot protrusion formed by the upper end of the bolt 130 extending beyond the tightening nut, the combination of the upper end of the bolt 130 and the recess 170, forming a pivot point and an upward limit stop for the blade and blade holder. Normally the upper end of the bolt 130, FIGS. 11 and 12, extends into the recess 170 in contact with the upper surface 168 to restrict movement of the blade in the lateral directions.

The blade holder and blade and the spacing support 160 are secured to the underside of the plate 12 by means of a leading bolt 96 and a trailing bolt 98. Surrounding the upper ends of the bolts are coil springs 100 and 102 having their lower ends in biasing contact with the upper surface of the plate 12 and have their upper ends tightened by nuts 172 and 174. The nuts are tightened so that the springs normally bias the bolts, the blade holder, the blade, and the plate 160 towards the plate 12.

The blade holder 114 and the carbide tip blade 116 function on typical concrete floors as described above except for the difference in the upwardly limiting pivot and elongated movement restriction arrangements. A primary difference between this embodiment and the one described above is that when a leading edge, as 120, wears excessively the rectangular carbide tip can be rotated and/or inverted so that all eight edges can be used as a leading scraping edge.

In FIGS. 13–17, a third embodiment is illustrated, wherein an inventive combination is formed on a scraper plate 180, similar to the scraper plate 12 in FIGS. 2–4, and securable to a plate as 30 by bolts 40 in FIG. 3. Inventive assemblies on a plate 180 are comprised of three equally, annularly spaced scraper units generally designated as 182, only one of which is shown. Each unit 182 has an elongated blade holder 184 having a leading portion 186 and a trailing portion 188, and a rectangular carbide tip blade 190, similar to blades 116, FIG. 10, which have eight cutting or scraping edges, as 192, 194, 196, 198, 200, 202, and 204.

As described above, the cutting edges are positioned transversely in a scraping position at the forward or leading end of the blade holder to which they are secured by a button head socket cap screw 210. A washer 212 is positioned between the screw head and an underface 214 of the rectangular blade, and surrounding the cap screw in a cylindrical hole 216 is a plastic insert busing 218. The top face of the blade 190 is held in abutment with the underface 222 of the leading portion 186 of the blade holder and the cap screw extends through a slot 226 of the blade holder. The cap screw is surrounded by a lock washer 228 and is tightened and held in place by a nut 230. For additional holding of the blade 190, a bar 232 is secured to the underside of the leading portion of the blade holder by welding or other conventional means and the blade 190 is positioned when secured by the cap screw 210 to be in abutment with the bar 232, edge 192 being the leading edge.

The leading portion 186 of the blade holder is bent or formed to extend downwardly from the trailing portion 188 which has an elongated transverse brake-type bend at its transverse centerline 236 to form an upper contacting edge or rounded surface with the lower side of the plate 180. Bolt holes 238 and 240 extend through the trailing portion and have their centers generally along the transverse centerline 236.

In this embodiment the apex of the trailing portion formed at the centerline 236 fits directly in contact with the under surface of the plate 180 and to protect the under surface of the plate 180 and the holes therethrough, hardened insert bushings 244 and 246 are threadedly engaged in tapped holes 248 and 250 in the plate 180. At their lower ends the bushings have annular flanges 252 and 254 to provide additional support. The holes 248, 250 are countersunk to receive the flanges 252, 254.

The blade holder 184 and the blade 190 thereon are secured to the underside of the plate 180 by means of a leading bolt 256 and a trailing bolt 258, the bolts extending through the openings 238 and 240 in the blade holder and through the hardened insert bushings 244 and 246. Surrounding the upper ends of the bolts are coil springs 260 and 262 having their lower ends in biasing contact with the upper surface of plate 180 and having their upper ends tightened by nuts 264 and 266. As described above, the nuts are tightened so that the springs normally bias the bolts, the blade holder and the blade toward the plate 180.

Above the upper end of the cap screw 210, there is threadedly engaged through the plate 180 an adjusting pivot seat, generally designated as 270, formed on a bolt 272 having a downwardly opening recessed head 274, the recess 276 being adapted to receive the nut 230 and the upper end of the cap screw 210. The bolt 272 extends through a tapped hole 278, has a washer 280 on the upper surface of the plate 180, and is tightened or adjusted in place by a nut 282.

At the start of a scraping operation the upper end of the cap screw 210 is adjacent the upper surface of the recess 276 or in contact therewith. In a normal operating situation where the blade leading edge 196 is moving smoothly and not being raised or lowered, the upper end of the cap screw 210 and the upper surface of the recess 276 tend to be in contact and tend to remain so until the blade of an individual scraping unit goes into a low spot on the floor or into a higher spot or moves onto residues or obstacles which tend to increase resistance. When the blade hits a higher spot, it first tends to dig in, as shown in FIG. 7, the blade moving downwardly and causing the forward spring 260 to be compressed, allowing the after spring 262 to be somewhat extended. However, immediately afterward as it moves along, against a protrusion, the blade raises and the cap screw 210 moves against the upper surface of the recess 276. It pivots thereon so as to lessen the load on the spring 260 and to compress the spring 262, the trailing end of the blade holder tending to move downwardly. The nut 230 being in the recess 276 restricts movement of the blade in the lateral directions and reduces wear on bolts 256, 258.

The blade rotates transversely as described with respect to FIGS. 5 and 6.

As the blade leading edge tends to wear during use, the adjusting device 270 is moved downwardly by rotating the threaded portion of the bolt 272 in the plate 180, FIG. 16. At the same time the nut 264 on the bolt 240 is loosened. Generally the adjusting seat at the upper surface of the recess 276 is lowered approximately 0.050" so as to change the pitch of the blade leading edge enough to provide a new leading edge as shown in FIG. 16. After the leading edge is worn to somewhat less than halfway through or in accordance with the limit provided by the head of the cap screw 210, one of the seven other edges of the blade 190 is positioned to be the leading edge. This adjusting extends the life of each edge of the blade 190 up to 500% under ideal conditions.

The invention and its attendant advantages will be understood from the foregoing description and it will be apparent that various changes may be made in the form, construction, and arrangements of the parts of the invention without departing from the spirit and scope thereof or sacrificing its material advantages, the arrangements hereinbefore described being merely by way of example. I do not wish to be restricted to the specific form shown or uses mentioned except as defined in the accompanying claims.

What is claimed is:

1. A rotary scraper for use on a rotatable plate to remove adhering materials from concrete floors and the like, comprising:

an elongated scraper blade having leading and trailing portions, said blade being formed at an intermediate portion so that said blade leading portion depends from the trailing portion and for extending toward the floor;

said scraper blade having hardened leading and side edges on its leading portion, the side edges trailing from the leading edge toward the trailing portion; said trailing portion having a trailing edge opposite said blade leading edge;

the side edges to extend generally in the direction of rotation, and the leading edge extending transversely to and between said side edges to extend generally transversely to the direction of rotation; said blade being elongated between the leading and trailing edges and being substantially longer between the leading and trailing edges than transversely along the leading edge; and an elongated support plate terminating in a trailing portion formed of two generally flat parallel surfaces in two generally parallel planes, one of said surfaces extending on and above an upper surface of said blade trailing portion and terminating adjacent the blade trailing edge above the blade trailing portion, and for securing to said rotatable plate with said blade;

said support plate having a leading portion for extending over said leading portion of the blade adjacent its leading edge and having downwardly extending means adjacent the leading edge for contact therewith for limiting upward movement of the blade leading portion and its leading edge with respect to the support plate when secured to said rotatable plate;

said trailing portions of said blade and support plate having means for receiving fasteners to secure said blade and said support plate to said rotatable plate.

2. The invention according to claim 1 in which:

said means is a downwardly pointed leading end of said support plate, a lower end of said means being adjacent the leading portion of the blade and its leading edge.

3. The invention according to claim 2 including:

means to bias said blade toward said rotatable plate when said support plate and said blade are secured to said rotatable plate.

4. The invention according to claim 3 in which:

said trailing portion of said blade is transversely bent along said support plate, the transverse bend being generally convex with respect to said support plate and having an elongated top of the bend forming the uppermost surface of said trailing portion;

said top being in the approximate transverse center of the trailing portion.

5. The invention according to claim 4 in which:

said downwardly pointed leading end is transversely centered on said support plate and with respect to the blade.

6. A motor driven rotary scraper assembly for use on concrete floors and the like for removing adhering residues, asphalt tile, and built-up paint and the like, comprising:

a generally disk-shaped plate for rotary driven attachment to a floor cleaning-polishing unit or the like;

a plurality of annularly spaced scraper units secured to said disk-shaped plate;

each scraper unit having an elongated scraper blade having leading and trailing portions, each blade being formed at an intermediate portion so that said blade leading portion depends from the trailing portion, extending away from the disk-shaped plate and for extending toward the floor; and each blade has hardened leading and side edges on its leading portion, the side edges trailing from the leading edge; each trailing portion having a trailing edge opposite said blade leading edge;

the side edges extending generally in the direction of rotation, and the leading edge extending transversely to and between said side edges and extending generally transversely to the direction of rotation; each blade being elongated between the leading and trailing edges and being substantially longer between the leading and trailing edges than transversely along the blade leading edge;

each scraper unit having an elongated support plate terminating in a trailing portion formed of two generally parallel flat surfaces in two generally parallel planes, one of said surfaces extending on and above an upper surface of said blade trailing portion and terminating adjacent the blade trailing edge above the blade trailing portion, and being between the blade and the disk-shaped plate in contact therewith;

said support plate having a leading portion extending over the leading portion of the blade adjacent its leading edge and having downwardly extending limit means for contact with the blade to limit upward movement of the blade leading portion and its leading edge toward the disk-shaped plate.

7. The invention according to claim 6 in which:

said limit means is a downwardly extending and pointed leading end of the support plate, a lower end of the downwardly extending leading end of the support plate being adjacent the leading portion of the blade and its leading edge.

8. The invention according to claim 7 in which:

each scraper unit being secured to the disk-shaped plate by fasteners extending through the blade trailing portion, the support plate, and the disk-shaped plate;

coil springs surrounding the fasteners and extending between the disk-shaped plate and securing means on the adjacent ends of the fasteners.

9. The invention according to claim 8 in which:

the trailing portion of the blade is transversely bent along said support plate, the transverse bend being generally convex with respect to and support plate and having an elongated top of the convex bend forming said upper surface of said trailing portion;

said top being in the approximate transverse center of the trailing portion;

said fasteners extending through said approximate transverse center;

said lower end of the downwardly extending leading end of the support plate being transversely centered on the support plate and with respect to the blade, whereby said blades are permitted to rotate transversely and upwardly and downwardly against the bias of the springs.

10. The invention according to claim 9 in which:

the springs are tightened against the disk-shaped plate to substantially eliminate rotation of the blade relative to the disk-shaped plate.

11. The invention according to claim 6 including:

openings in said disk-shaped plate for passage of liquid through said disk-shaped plate and onto a floor.

12. A motor driven rotary scraper assembly for use on concrete floors and the like for removing adhering residues and coatings, comprising:

a plate for rotary driving attachment to a motor rotatable device;

a plurality of annularly spaced scraper units secured to said plate;

each scraper unit having an elongated scraper blade having leading and trailing portions;

a spacing member between each blade trailing portion and said plate;

fasteners extending through each blade trailing portion, each respective spacing member, and said plate to secure said units to said plate;

means associated with said fasteners to bias said trailing portions toward said plate and to permit upward and downward movement of said leading portions against the force of the means to bias relative to the plate and spacing member; and means on each trailing portion adjacent said respective spacing member to permit rotation of each blade on the spacing members transversely to the elongated direction of the blade, the transverse rotation being against the force of the means to bias.

13. The invention according to claim 12 including:

openings in said plate for the passage of liquid through the plate and onto a floor.

14. The invention according to claim 12 in which:

each blade has hardened leading and side edges on said leading portion, the side edges trailing from the leading edge;

the side edges extending generally in the direction of rotation, and the leading edge extending generally transverse to the direction of rotation.

15. The invention according to claim 12 in which:

each leading portion of a blade extends downwardly from the trailing portion away from the plate to extend toward the floor.

16. The invention according to claim 15 in which:

each spacing member has a leading part extending over the leading portion of a respective blade and has limit means to limit upward movement of the blade leading portion toward the plate and the leading part.

17. The invention according to claim 16 in which:

said limit means on each spacing member to limit upward movement of the blade leading portion is a downwardly facing means adjacent the blade leading edge and is in combination with means on said blade leading portion for limiting upward movement thereof with respect to the spacing member.

18. The invention according to claim 17 in which:

said means on said blade leading portion is an upper end of a protrusion on said blade leading portion; and said means on said spacing member is a downwardly facing opening to receive said protrusion when a respective blade leading portion is moved upwardly.

19. The invention according to claim 18 in which:

said upper end of each protrusion on each blade leading portion is the upper end of a fastener, securing a blade member on a lower side of a respective blade leading portion, each blade member having hardened leading and side edges on respective blade leading portions.

20. The invention according to claim 19 in which:

each blade member has eight hardened edges, each of which is positionable to be a leading edge on a respective blade leading portion.

21. The invention according to claim 20 in which:

each blade member is secured against rearward movement along a transverse trailing edge of the blade member by a respective transverse bar secured to the lower side of each blade leading portion.

22. The invention according to claim 16 in which:

each limit means is a downwardly extending leading end of the leading part of each spacing member;

a lower end of each downwardly extending leading end of the leading part being adjacent the leading portion of the respective blade.

23. The invention according to claim 22 in which:

said means on each trailing portion adjacent a respective spacing member is a transverse bend extending along the trailing portion of the blade and having an elongated top of the transverse bend in the approximate transverse center of the blade trailing portion.

24. The invention according to claim 22 in which:

said fasteners extend through said approximate transverse center.

25. The invention according to claim 12 in which:

the fasteners are tightened on the means to bias to eliminate the biasing effect and to substantially eliminate movement of the blades relative to the plate and spacing members.

26. A rotary scraper for use on a rotatable plate to remove adhering materials from concrete floors and the like, comprising:

an elongated scraper blade holder having leading and trailing portions, and opposite respective leading and trailing ends;

said blade holder being formed at an intermediate portion so that said blade holder leading portion depends from the blade holder trailing portion and for extending closer toward the floor than the trailing portion;

a scraper blade on the leading end of the holder and having hardened leading and side edges, the side edges trailing from the leading edge toward the blade holder trailing portion;

the side edges to extend generally in the direction of rotation, and the leading edge to extend generally transversely to the direction of rotation; and means on said blade holder leading portion adjacent the leading edge for limiting upward movement of the blade holder leading portion and blade leading edge with respect to said rotatable plate, and for securing the blade to the blade holder;

said trailing portion of said blade holder having means for receiving fasteners to secure said blade holder to said rotatable plate.

27. The invention according to claim 26 including:

an elongated support plate having a trailing portion extending on an upper surface of said blade holder trailing portion and for securing to said rotatable plate with said blade holder and blade;

said support plate having a leading portion for extending over said leading portion of the blade holder and having downwardly facing means adjacent the blade leading edge for limiting upward movement of the blade holder leading portion and the blade leading edge in combination with said means on said blade holder leading portion, said limiting upward movement being with respect to the support plate when secured to the rotatable plate.

28. The invention according to claim 27 in which:

said means on said blade holder leading portion is an upper surface thereof trailing said blade leading edge; and said means on said support plate is a downwardly pointed leading end of said support plate;

a lower end of said pointed leading end being adjacent the leading portion of the blade holder and the blade leading edge.

29. The invention according to claim 28 in which:

said downwardly pointed leading end is transversely centered on said support plate and with respect to the blade.

30. The invention according to claim 27 in which:

said means on said blade leading portion is an upper end of a protrusion on said blade leading portion; and said means on said support plate is a downwardly facing opening to receive said protrusion.

31. The invention according to claim 30 in which:

said upper end of said protrusion on said blade holder leading portion is the upper end of a fastener, securing the blade on a lower side of said blade holder leading portion.

32. The invention according to claim 31 in which:

said blade has eight hardened edges, each of which is positionable to be a leading edge on said blade holder leading portion.

33. The invention according to claim 32 in which:

said blade is secured against rearward movement along a transverse trailing edge of the blade by a transverse bar secured on the lower side of said blade holder leading portion.

34. The invention according to claim 30 in which:

said protrusion when received in said opening restrict the movement of the blade leading portion with respect to the support plate in the direction transverse to the direction of rotation.

35. The invention according to claim 26 in which:

said means on said blade holder leading portion is an upper end of a protrusion on said blade holder leading portion for engaging a part of a protrusion extending downwardly from the rotatable plate, the engagement of the protrusions limiting the upward movement of the blade leading portion.

36. The invention according to claim 35 in which:
the protrusion for extending downwardly from said rotatable plate is for adjusting upwardly and downwardly in accordance with wear on the leading edge of the blade.

37. The invention according to claim 36 in which:
said upper end of said protrusion on said blade holder leading portion is the upper end of a fastener, securing the blade on a lower side of said blade holder leading portion.

38. The invention according to claim 37 in which:
said blade has eight hardened edges, each of which is positionable to be a leading edge on said blade holder leading portion.

39. The invention according to claim 38 in which:
said blade is secured against rearward movement along a transverse trailing edge of the blade by a transverse bar secured on the lower side of said blade holder leading portion.

40. The invention according to claim 39 in which:
the protrusion for extending downwardly and for adjusting is a bolt for being threadedly engaged within said rotatable plate.

41. The invention according to claim 35 in which:
said part of said protrusion extending downwardly from said rotatable plate is a downwardly opening recess, and when engaged by said upper end of said protrusion on said blade holder leading portion, said blade holder leading portion is restricted in lateral movement with respect to said rotatable plate.

42. The invention according to claim 26 including:
means to bias said blade holder and blade toward said rotatable plate when said blade is secured to said rotatable plate.

43. The invention according to claim 42 in which:
the trailing portion of said blade holder is bent transversely to the direction of rotation along its upper elongated surface;
the transverse bend being generally convex and having and elongated top of the bend forming the uppermost surface of the trailing portion;
said top being in the approximate transverse center of the trailing portion.

44. A motor driven rotary scraper assembly for use on concrete floors and the like for removing adhering residues and coatings, comprising:
a plate for rotary driving attachment to a motor rotatable device;
a plurality of annularly spaced scraper units secured to the underside of said plate;
each scraper unit having an elongated scraper blade having leading and trailing portions,
fasteners extending through each blade trailing portion and said plate to secure said units to said plate;
means associated with said fasteners to bias said trailing portions towards said plate and to permit upward and downward movement of said leading portions against the force of the means to bias relative to the plate; and
means on each trailing portion adjacent said plate to permit rotation of each blade on the plate transversely to the elongated direction of the blade, the transverse rotation being against the force of the means to bias.

45. The invention according to claim 44 including openings in said plate for the passage of liquid through the plate and onto a floor.

46. The invention according to claim 44 in which:
each blade has hardened leading and side edges on said leading portion, the side edges trailing from the leading edge;
the side edges extending generally in the direction of rotation, and the leading edge extending generally transverse to the direction of rotation.

47. The invention according to claim 44 in which:
each leading portion of a blade extends downwardly from the trailing portion away from the plate to extend toward the floor.

48. The invention according to claim 47 including:
limit means adjacent each blade to limit upward movement of the blade leading portion toward the plate.

49. The invention according to claim 48 in which:
said limit means are an upper end of a respective protrusion on each blade leading portion for engaging a lower part of a respective protrusion extending downwardly from the rotatable plate, the engagement of the respective protrusions limiting the upward movement of the respective blade leading portions.

50. The invention according to claim 49 in which:
said protrusions extending downwardly from the rotatable plate are bolts threadedly engaged within the rotatable plate, the bolts being rotatable to move upwardly and downwardly for adjustment of the movement of the blade in accordance with the wear on the leading edge of the blade.

51. The invention according to claim 50 in which:
each upper end of a respective protrusion on said blade leading portion is an upper end of a fastener, securing a blade member on a lower side of each respective blade leading portion, each blade member having said hardened leading and side edges.

52. The invention according to claim 51 in which:
each blade member has eight hardened edges, each of which is positionable to be a leading edge on each respective blade leading portion.

53. The invention according to claim 52 in which:
each blade member is secured against rearward movement along a transverse leading edge of a respective transverse bar secured on a lower side of each blade leading portion.

54. The invention according to claim 53 in which:
each bolt threadedly engaged within the rotatable plate has a recess in its lower end receiving an upper end of a protrusion extending from a blade leading portion when the protrusions are engaged, to restrict the blade leading portion in lateral movement with respect to the plate.

55. The invention according to claim 44 in which:
said means on each blade trailing portion adjacent the plate to permit rotation of each blade is a transverse bend extending along the trailing portion of the blade and having an elongated top of the transverse bend in the approximate transverse center of the blade trailing portion.

56. The invention according to claim 55 in which:
said fasteners extend through said approximate transverse center.

57. The invention according to claim 55 including:
means in said rotatable plate to prevent plate wear by the movement of the blade trailing portion with respect to the plate.

58. The invention according to claim 57 in which:
said means in said rotatable plate are hardened insert bushings through which the fasteners extend, said bushings having flanges on their lower ends having surfaces adjacent the trailing portion of the blade.

59. The invention according to claim 44 in which:
the fasteners are tightened on the means to bias to eliminate the biasing effect and to substantially eliminate movement of the blades relative to the plate and spacing members.

* * * * *

UNITED STATES PATENT AND TRADEMARK OFFICE

CERTIFICATE OF CORRECTION

PATENT NO. : 4,614,380

DATED : September 30, 1986

INVENTOR(S) : Larry D. Allen

It is certified that error appears in the above-identified patent and that said Letters Patent are hereby corrected as shown below:

Column 2, line 4, "the" should be -- The --.

Column 5, line 28, "on" should be -- onto --.

Column 8, line 53, "busing" should be -- bushing --.

Claim 9, column 12, line 5, "and", first occurrence, should be -- said --.

Claim 43, column 15, line 47, "and" should be -- an --.

Signed and Sealed this

Tenth Day of February, 1987

*Attest:*

DONALD J. QUIGG

*Attesting Officer*

*Commissioner of Patents and Trademarks*